US008002209B2

(12) United States Patent
Frey et al.

(10) Patent No.: US 8,002,209 B2
(45) Date of Patent: Aug. 23, 2011

(54) METHOD FOR OPERATING A FRAGMENTATION SYSTEM AND SYSTEM THEREFOR

(75) Inventors: Wolfgang Frey, Karlsruhe (DE); Ralf Strässner, Karlsruhe (DE); Andreas Schormann, Alzenau (DE); Kurt Giron, Mömbris (DE); Harald Giese, Stutensee (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 921 days.

(21) Appl. No.: 10/571,459

(22) PCT Filed: Jul. 28, 2004

(86) PCT No.: PCT/EP2004/008414

§ 371 (c)(1),
(2), (4) Date: Dec. 10, 2007

(87) PCT Pub. No.: WO2005/028116

PCT Pub. Date: Mar. 31, 2005

(65) Prior Publication Data

US 2008/0283639 A1 Nov. 20, 2008

(30) Foreign Application Priority Data

Sep. 13, 2003 (DE) ..... 103 42 376

(51) Int. Cl.
*B02C 19/00* (2006.01)

(52) U.S. Cl. ..... 241/1; 241/301; 241/21

(58) Field of Classification Search ..... 241/1, 301, 241/21

See application file for complete search history.

(56) References Cited

U.S. PATENT DOCUMENTS

| | | | | |
|---|---|---|---|---|
| 3,715,082 | A | 2/1973 | Carley-Macauly et al. | |
| 3,770,212 | A * | 11/1973 | Kassir et al. | 241/1 |
| 4,540,127 | A * | 9/1985 | Andres | 241/1 |
| 4,964,576 | A * | 10/1990 | Datta | 241/19 |
| 5,522,553 | A * | 6/1996 | LeClair et al. | 241/21 |
| 7,500,623 | B2 * | 3/2009 | Paris et al. | 241/1 |
| 7,838,843 | B2 * | 11/2010 | Kawakami et al. | 250/432 R |
| 2008/0135656 | A1 * | 6/2008 | Bradley et al. | 241/101.6 |

FOREIGN PATENT DOCUMENTS

| | | |
|---|---|---|
| DE | 195 34 232 | 3/1997 |
| FR | 1 341 851 | 11/1963 |
| RU | 2 069 588 | 11/1996 |
| SU | 888 355 | 11/1991 |

OTHER PUBLICATIONS

Database WPI, Section PQ, Week 199230, Derwent Publications Ltd., London, GB, AN 1992-247817, XP002300057 (corresponding to SU 888 355). Database WPI, Section PQ, Week 199729, Derwent Publications Ltd., London, GB; AN 1997-318137, XP002300058 (corresponding to RU 2 069 588).

* cited by examiner

*Primary Examiner* — Bena Miller
(74) *Attorney, Agent, or Firm* — Venable LLP; Robert Kinberg; Leigh D. Thelen

(57) ABSTRACT

A fragmentation system including a reaction vessel with processing fluid and fragmentation product and a pair of electrodes. Two respective ends of the pair of electrodes are arranged at a distance to each other inside the reaction vessel and can be admitted with pulsed high-voltage to grind the fragmentation product positioned in a reaction zone. The system also including a solid/fluid separation device, a suspension device to keep the fragmentation product continually suspended in the processing fluid, and a transfer device to transfer processing fluid and a first share of the fragmentation product out of the reaction vessel to the solid/fluid separation device. A second share of the fragmentation product returns to the reaction zone. The system includes at least one return-flow line coupled to the solid/fluid separation device and the reaction vessel to empty the processing fluid from the solid/fluid separation device into the reaction vessel.

6 Claims, 1 Drawing Sheet

METHOD FOR OPERATING A FRAGMENTATION SYSTEM AND SYSTEM THEREFOR

CROSS-REFERENCE TO RELATED APPLICATION

This application is a U.S. National Stage of PCT/EP04/08414 filed Jul. 28, 2004 designating the United States and claiming priority to German document DE 10342376.1 filed Sep. 13, 2003.

BACKGROUND

The invention relates to a method for operating a fragmentation system to achieve a more effective grinding of a fragmentation product, consisting of mineral and/or brittle materials, into target particle sizes of <5 mm, as well as to a fragmentation system operating on the basis of said method.

The technical principle used for the fragmentation system is based on the FRANKA technology (FRANKA=Fragmentieranlage Karlsruhe=fragmentation system Karlsruhe), as described in reference DE 195 34 232. The fragmentation system consists of an electric energy store which is discharged in a pulsed mode into a reaction vessel and into the fragmentation products, which are submerged in a processing fluid in the region between two electrode ends that are positioned at a distance to each other, the reaction zone.

For the grinding of the material by means of the fragmentation system, the fragmentation product positioned between the two electrode ends in the processing fluid is fragmented with the aid of disruptive electric breakdowns and the shockwaves generated as a result. These mineral and/or brittle materials can have a uniform structure such as rock/stone or glass, or they can have a conglomerate structure such as sedimentary rock and concrete. The target particle sizes are <5 mm and preferably even <2 mm. Fragmented particles below this particle size are extracted from the process area by means of filter cartridges, e.g. as for the gravel and sand production, or the grinding of color bodies, or in general for materials that are not compound materials. Fragmentation products such as products obtained when tearing down a building are continuously filled back into the process area to replenish the amount of fragmentation product which is removed.

The fragmentation system comprises an electric energy store that is discharged in the form of a pulsed discharge via a spark gap into a load, wherein this load is the processing fluid with therein submerged fragmentation product in the region between the electrodes. The two electrodes are positioned opposite each other in the processing fluid, at a predetermined, adjustable distance relative to each other, wherein the electrode ends are completely submerged. The reaction vessel normally contains the processing fluid into which the product to be fragmented is poured and from which the fragmented product with particle sizes at or below the predetermined threshold value is subsequently removed.

SUMMARY

So far, the assumption has been that as a result of the discharges into the region between the two electrode ends, primarily the high-voltage electrode and the bottom and/or a partial region thereof, the fragmentation product is repeatedly stirred up sufficiently during these pulsed discharges. However, a series of experiments has shown that the material is stirred up only insufficiently.

It is therefore the object of the present invention to achieve a more effective fragmentation of the product positioned in the region between the electrodes by keeping this product suspended to save processing time and energy.

With respect to the method, this object is solved by the step disclosed in an embodiment of the invention including stirring up the fragmentation product in the region filled with the processing fluid, meaning the space between the electrode ends and the bottom of the reaction vessel with thereon deposited fragmentation product. The fragmentation product in the processing fluid is kept continually suspended, thus forming a suspension together with the processing fluid. From this suspension, the share of the processed fragmentation product which matches or falls below the target particle size is then discharged from the reaction vessel while the share of the fragmentation product which exceeds the target particle size—meaning the rough particles—is fed back into the reaction zone.

This object is solved for the subject matter with a fragmentation system, wherein a device for keeping the fragmentation product suspended in the processing fluid is mounted either on or in the reaction vessel because no air with a relative dielectric constant $\in_r$ near 1, as well as no gas with the same $\in_r$, should be allowed to enter the processing chamber. Furthermore mounted on or in the reaction vessel is a device for transferring out the share of the suspended fragmentation product with particle sizes starting at or below the target particle size. Subsequently, this share is supplied to a device for the solid/fluid separation while the share of the fragmentation product with particle sizes above this target particle size is returned to the reaction vessel. For this, at least one return-flow line for the processing fluid empties into the reaction vessel.

Additional measures for a more advantageous, case-by-case realization of the fragmentation process are described. To keep the fragmentation product effectively suspended, one embodiment of the invention discloses the use of hydrodynamic measures, such as creating flows, while another embodiment of the invention describes the use of mechanical measures such as stirring or shoveling. The flow direction and flow intensity, as well as the stirring and shoveling speed, can be controlled and adjusted for optimizing the fragmentation process.

According to another embodiment of the invention, the upcurrent classification method is used for transferring out the processed share of the fragmentation product. Following a solid/fluid separation, the rough particle share of the product, for which the particle size exceeds the target particle size, is then returned to the reaction vessel. According to another embodiment of the invention, the hydro-cycloning method is used for this separation. According to yet another embodiment of the invention, finally, this separation is achieved by using different types of filters submerged in the processing fluid, such as filter baskets or filter cartridges.

Other embodiments of the invention provide measures for advantageously outfitting the fragmentation system.

Maintaining the suspension is important for achieving a continuous and economic operation of the fragmentation system. For this, the fragmentation system must be set up and adjusted according to an embodiment of the invention in such a way that the product to be fragmented is kept suspended in the processing fluid without forming dead zones. An embodiment of the invention provides an upcurrent classification unit which is set up for separating the fragmentation product while another embodiment provides the use of a hydro cyclone as an alternative solution for separating the fragmented products. A further embodiment of the invention finally provides devices known in the field of screening technology, for example filters in the form of baskets, cartridges, and the like. In that case, owing to the effect of the shock waves generated by the electrical discharge, the distance to the region between the electrodes is adjusted to allow for an effective cleaning, while simultaneously avoiding destruction, wherein the intensity decreases at the rate of $1/r^2$ starting with the source of the shock waves.

According to an embodiment of the invention, the suspension is maintained with inflow nozzles through which the processing fluid that is recovered during the solid/fluid separation is guided back into/flows back into the reaction vessel, in a controlled and directed manner.

Owing to these measures, fine-particle shares of the fragmentation product can be kept suspended in the processing fluid during the fragmentation process and can be returned again and again to the region of electrical discharge. For this, the suction cartridge, or also the suction cartridges, is (are) positioned such that the fragmentation product will impact with high probability with the cartridges, so that sufficiently small particle sizes are extracted. With each discharge operation, fragments suspended from the screen of the suction cartridge, which are still too large, are shaken off by the shock wave(s) triggered by the discharge channel or channels.

One embodiment described herein, meaning the embodiment with "circular piping," is specifically disclosed herein with reference to the drawing. Based on preliminary experiments, this embodiment represents a favorable solution with respect to flow technology. Additional solutions to be considered can include the use of a directional pipe and/or a pipe bundle. In any case, attention must be paid when designing and setting up the system to avoid dead flow zones in which fine particles could collect and could be deposited.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
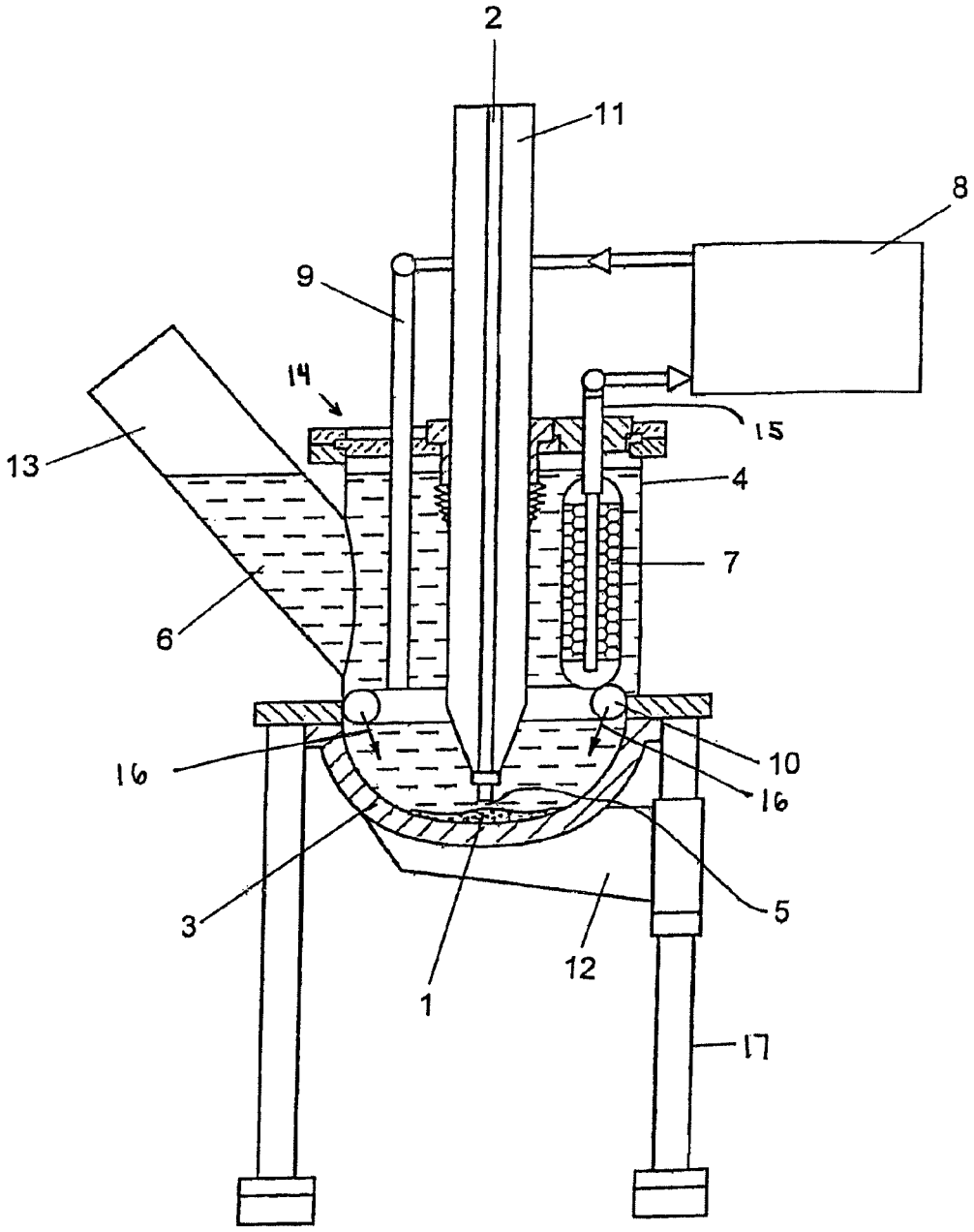
FIG. 1 shows a barrel-shaped reaction vessel according to an embodiment of the invention.

The reaction vessel itself is the only part of the fragmentation system which is shown herein. The electrical components, meaning the charging device, the energy store, and the spark gap are components known among other things from the above-cited prior art sources. The electrical energy store primarily takes the form of a bank of capacitors, with the energy being discharged via spark gaps in-between and with the aid of automatic disruptive breakdowns, discharged onto the load in the region between the electrodes in the reaction vessel. In FRANKA-type systems, the electrical component is a Marx generator, for which the electrical charging and discharging method is known from the field of electrical high-power/voltage pulse technology.

FIG. 1 shows a barrel-shaped reaction vessel 4 which rests on support legs 17. A high-voltage electrode 2 is electrically insulated up to its exposed end region and includes an insulation sheath 11. The high-voltage electrode 2 projects through a lid 14 into the reaction vessel 4. The high voltage electrode 2 is not held rigidly in the lid 14, so that the impulse and shock wave effect, caused by the electrical discharge, cannot be transmitted. The exposed, metallic end region is completely submerged in the processing fluid or liquid 6 inside the reaction vessel 4, which in this case is water, wherein even the covering insulation part projects far into the water. No creep distances should form thereon during a long-term operation. With this embodiment, the bottom of the reaction vessel 4 forms a counter electrode 3 (or earth potential electrode) that curves downward, for example in the manner of a ball, wherein this can refer to the complete bottom or only a central region thereof. In any case, the counter electrode 3 is connected to a fixed potential, the reference potential, which generally is the earth potential. A centrally deposited fragmentation product 1 is indicated on the earth potential electrode 3. Starting with the tip of the high-voltage electrode 2, a discharge channel (or reaction zone) 5 that forms should extend through the fragmentation product 1 to the earth potential electrode 3 and/or a cone-shaped region of discharge channels 5 should extend in the same way from the front of the high-voltage electrode 2 toward the center of the bottom region.

Projecting through the lid 14 of the reaction vessel 4 are a water supply line (and/or return flow line) 9 and a discharge line 15 for the water or processing fluid loaded with fragmentation product 1, which arrives from a filter cartridge 7. In order to optimize the fragmentation processes, the intensity of the flow responsible for stirring up the product and its direction at the start of the flow are controlled. For this embodiment, the device for generating a flow and stirring up the fragmentation product surrounds the high-voltage electrode 2 coaxially. A feed line (not shown) feeds into a coaxially arranged closed circular pipeline 10. The closed circular pipeline 10 is electrically secure and is attached to a wall of the reaction vessel 4, so that it can resist shock waves with tolerable expenditure.

Depending on the fragmentation product, an outflow direction of the nozzles, represented by arrows 16, can be adjusted and/or re-adjusted to obtain an optimum stirring up during the operation. The flow intensity is adjusted with the aid of a pump (not shown), which pumps the pure processing fluid into the closed circular pipeline 10. The nozzles direct the flows along the bottom and toward the bottom center. In this way, the fragmentation product 1 previously deposited on the bottom or the product being deposited thereon is continually stirred up and kept suspended, thus avoiding areas without flow in the complete water volume.

The filter cartridge 7 is completely submerged in water or processing fluid. A mesh width of a grid surrounding the filter cartridge determines the largest particle size that can be extracted. The suspension flowing through the filter cartridge 7 is then separated inside the centrifuge (or the solid/fluid separation device) 8, into the fluid share, meaning the processing water, and the solid particle share. The water is returned to the reaction vessel by way of the feed line (or the one return-flow line) 9 for the closed circular pipeline 10, wherein fresh water can be added along the way.

New fragmentation material is filled in/poured in through a connection pipe section 13 that projects from the reaction vessel 4.

Depending on the size of the reaction vessel 4, maintenance and repair operations are considerably facilitated if the bottom of the reaction vessel can be screwed off and can be moved to the side by means of the projecting arm or cantilever 12, which is attached pivoting to the support leg 17.

What is claimed is:

1. A fragmentation system for a more effective grinding of mineral and/or brittle materials, said system comprising:

a reaction vessel provided with processing fluid and fragmentation product;

a pair of electrodes adapted to be coupled to an energy store, wherein two respective ends of the pair of electrodes are arranged at a distance to each other inside the reaction vessel, wherein one of the pair of electrodes comprises a high-voltage electrode;

wherein one of the two electrodes is connected to reference potential and the high-voltage electrode can be admitted by an output switch with pulsed high-voltage from the energy store to grind the fragmentation product positioned between the pair of electrodes in a reaction zone;

a solid/fluid separation device coupled to the reaction vessel;

a suspension device to keep the fragmentation product continually suspended in the processing fluid, is mounted on or in the reaction vessel;

a transfer device is mounted on or in the reaction vessel to transfer processing fluid and a first share of the fragmentation product that is below or equal to a target particle size out of the reaction vessel to the solid/fluid separation device, and wherein a second share of the fragmentation product with particles sizes exceeding the target particle size is returned to the reaction zone; and at least one return-flow line coupled to the solid/fluid separation device and the reaction vessel to empty the processing fluid from the solid/fluid separation device into the reaction vessel.

2. The fragmentation system according to claim 1, wherein the suspension device moves the fragmentation product suspended in the processing fluid through the reaction zone, without allowing dead zones to form.

3. The fragmentation system according to claim 2, wherein the transfer device comprises an upcurrent classifier.

4. The fragmentation system according to claim 2, wherein the transfer device comprises a hydro-cyclone.

5. The fragmentation system according to claim 2, wherein the transfer device comprises at least one filter to filter out the target particle size.

6. The fragmentation system according to claim 3, wherein processing fluid from the solid/fluid separation device is returned to the reaction vessel by one or a plurality of nozzles, such that the fragmentation product in the reaction zone is kept completely suspended.

* * * * *